US006636023B1

(12) United States Patent
Amin

(10) Patent No.: US 6,636,023 B1
(45) **Date of Patent: *Oct. 21, 2003**

(54) COMBINED LINEAR AND SWITCHING VOLTAGE REGULATOR

(75) Inventor: Dilip A. Amin, San Jose, CA (US)

(73) Assignee: Juniper Networks, Inc., Sunnyvale, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 136 days.

(21) Appl. No.: 09/418,696

(22) Filed: Oct. 14, 1999

(51) Int. Cl.[7] ..... G05F 1/40
(52) U.S. Cl. ..... 323/268
(58) Field of Search ..... 323/268, 269, 323/271, 273, 282, 276

(56) References Cited

U.S. PATENT DOCUMENTS 4,502,152 A * 2/1985 Sinclair ..... 323/268
5,083,078 A * 1/1992 Kubler et al. ..... 323/268
5,258,701 A * 11/1993 Pizzi et al. ..... 323/269

* cited by examiner

*Primary Examiner*—Shawn Riley
(74) *Attorney, Agent, or Firm*—Harrity & Snyder, LLP

(57) ABSTRACT

A voltage regulator having a regulator output operating at a predetermined output voltage level is disclosed. The voltage regulator includes a switching regulator that has a first regulated output providing a first output voltage level, where the first output voltage level is approximately equal to the predetermined output voltage. The first regulated output is coupled to the regulator output. The voltage regulator includes a linear regulator that has a second regulated output providing a second output voltage level, where the second output voltage level is less than the first output voltage level. The second regulated output is coupled to the first regulated output such that the voltage at the regulator output is maintained at approximately the predetermined output voltage level by operation of the switching regulator until the regulator output falls below the second output voltage level at which time the regulator output is maintained at approximately the predetermined output voltage level by operation of either the linear regulator or both the linear regulator and the switching regulator.

23 Claims, 2 Drawing Sheets

COMBINED LINEAR AND SWITCHING VOLTAGE REGULATOR

BACKGROUND OF THE INVENTION

The present invention relates generally to electrical circuits and components, and more particularly to a method and apparatus for regulating voltage in high power applications.

Many electronic components require a constant, stable direct current (DC) voltage source to operate properly. A voltage regulator is a type of electrical component that provides stable output voltage and variable output current. While a voltage regulator may be powered by a variable or unstable voltage source, a constant, stable voltage is available at the output of the voltage regulator.

A linear regulator is one type of voltage regulator that includes a linear control element and an electrical feedback element. The linear control element, often a transistor, is coupled in series with the unregulated input voltage. The feedback element is used to maintain a constant output voltage by comparing the output voltage to a stable, known voltage reference. The voltage drop across the linear control element is varied so the output voltage remains equal to the reference voltage, even while the input voltage varies. The output voltage is always lower than the unregulated input voltage as some power is dissipated in the control element. A shunt regulator is a type of linear regulator in which the linear control element is tied from output to ground rather than in series with the load. Linear regulators are advantageous because they respond very quickly to fluctuations in load current and input voltage. However, linear regulators often must dissipate a great deal of power, equal to the output current multiplied by the difference between the input and output voltages. Large power dissipation requires adequate cooling for proper operation of the regulator and surrounding components, necessitating a relatively large device or an additional cooling element.

Another type of voltage regulator is a switching regulator. A switching regulator includes a transistor operated as a saturated switch. The transistor applies the full unregulated input voltage across an inductor for short intervals. As the current builds up, the energy stored in the inductor is transferred to a filter capacitor at the output of the device. The output voltage is compared to a voltage reference and feedback is used to vary the pulse width and/or frequency of the periodic application of power by the transistor. Since switching regulators are either off or saturated, they dissipate very little power, which permits them to operate very efficiently and, therefore, to be relatively small and light. However, switching regulators respond relatively slowly to abrupt changes in current load or input voltage. In a switching regulator, many pulses of current through the inductor are required to compensate for an abrupt change in a current load or input voltage.

SUMMARY OF THE INVENTION

In a first aspect, the invention features a voltage regulator having a regulator output operating at a predetermined normal output voltage. The voltage regulator includes a switching regulator that has a first input and a first regulated output providing a normal first output voltage level, where the normal first output voltage level is approximately equal to the predetermined normal output voltage. The first regulated output is coupled to the regulator output. The voltage regulator includes a linear regulator that has a second input and a second regulated output providing a second normal output voltage level. The second normal output voltage level is less than the first normal output voltage level. The second regulated output is coupled to the first regulated output such that the voltage at the regulator output is maintained at approximately the predetermined normal output voltage by operation of the switching regulator until the predetermined normal output voltage falls below the second normal output voltage level at which time the regulator output is maintained at approximately the predetermined normal output voltage by operation of either the linear regulator or both the linear regulator and the switching regulator.

Implementations of the invention may include one or more of the following features. The second normal output voltage level may be approximately 1.5% less than the first normal output voltage level. The normal output voltage of the voltage regulator may be approximately 1.5 V.

DETAILED DESCRIPTION

Figure 1:
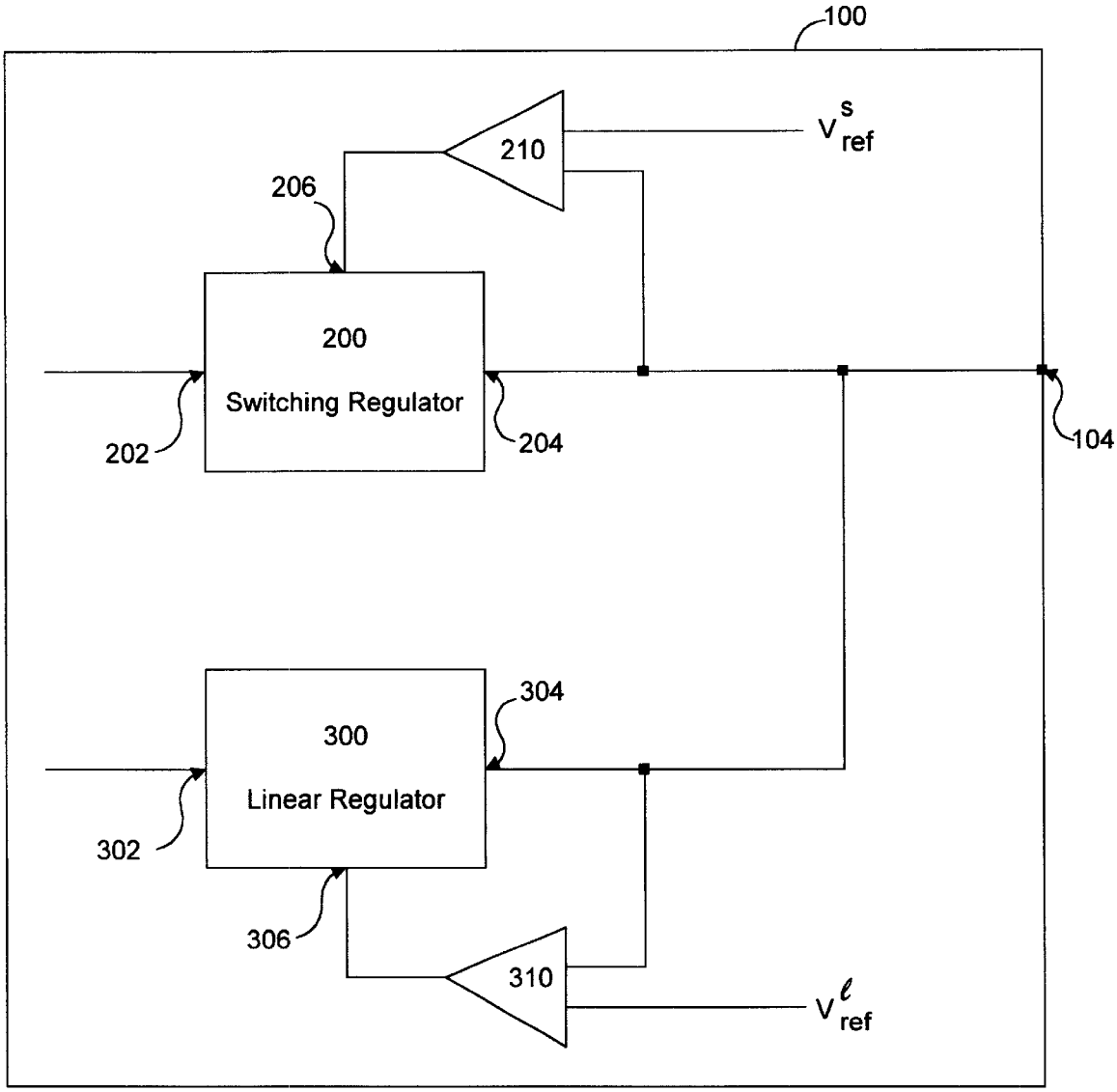
FIG. 1 is a block diagram of a booster voltage regulator.

Referring to FIG. 1, a booster voltage regulator 100 includes a switching regulator 200 and a linear regulator 300. The switching regulator 200 may be an International Power Designs, Inc. QBS050ZE-A or QBS030ZE-A, and the linear regulator 300 may be a Unitrode LDO Linear Regulator UC385-1 or UC385-ADJ. Input voltage signals are coupled to the inputs 202, 302 of switching regulator 200 and linear regulator 300, respectively. The input voltage signals coupled to inputs 202, 302 can be unregulated or line voltages and may be, but need not be, identical or in phase. Regulated output voltages are provided at each of the outputs 204, 304 of the switching regulator 200 and linear regulator 300. The outputs 204, 304 of the switching regulator 200 and linear regulator 300 are electrically connected to device output 104. Switching regulator 200 and linear regulator 300 each have a high impedance output (outputs 204, 304) so that negligible current from one flows into the output of the other.

Booster voltage regulator 100 includes two comparators 210, 310, a switching voltage reference, $V^s_{ref}$, and a linear voltage reference, $V^l_{ref}$, that are used by comparators 210 and 310, respectively. Comparator 210 compares the voltage $V_{out}$ at device output 104 of booster voltage regulator 100 with voltage $V^s_{ref}$. If $V_{out}<V^l_{ref}$ then comparator 210 provides a feedback signal to the switching regulator 200 through input 206 so that switching regulator 200 is turned on to drive $V_{out}$ higher. Comparator 310 compares the voltage $V_{out}$ at device output 104 of booster voltage regulator 100 with voltage $V^l_{ref}$. If $V_{out}<V^l_{ref}$ then comparator 310 provides a feedback signal to linear regulator 300 through input 306 so that linear regulator 300 is turned on and drives $V_{out}$ higher.

In normal operation (not abrupt load), booster voltage regulator 100 maintains $V_{out}$ approximately equal to a predetermined normal output voltage, $V_{norm}$. $V^s_{ref}$ is chosen approximately equal to $V_{norm}$, so that if $V_{out}$ falls below $V_{norm}$, comparator 210 provides a feedback signal to input 206 of switching regulator 200. Switching regulator 200 turns on in response to the feedback signal and remains on until $V_{out}=V_{norm}$.

Linear voltage reference, $V^l_{ref}$, is chosen such that it is approximately 1.5% lower than switching voltage reference, $V^s_{ref}$. Because $V^l_{ref}=0.985V^s_{ref}$, and $V^s_{ref}\approx V_{norm}$, comparator 310 provides a feedback signal to input 306 of linear regulator only when $V_{out}$ drops more than approximately 1.5% below $V_{norm}$. Thus, during normal operation, when the fluctuations of $V_{out}$ are typically much smaller than 1.5%, $V_{out}$ is driven by feedback from comparator 210 and by the operation of switching regulator 200. If $V_{out}$ dips below $V_{norm}$, switching regulator 200 slowly turns on in order to raise $V_{out}$ approximately equal to $V_{norm}$ again. During normal operation $V_{out}$ is maintained within approximately 0.25% of $V_{norm}$.

When the booster voltage regulator experiences a large, abrupt current load (a step load) at the output 104, or when the voltage as seen by the switching regulator at input 202 varies quickly with a large amplitude, switching regulator 200 alone may not operate fast enough to maintain $V_{out}$ within a few percent of $V_{norm}$ (≈1.5%, in one implementation). In such a case, if the output voltage $V_{out}$ drops below $V^l_{ref}$, then a feedback signal from comparator 310 will cause linear regulator 300 to turn on. Linear regulator 300 ensures that $V_{out}$ is maintained within approximately 3% of $V_{norm}$ even during large fluctuations of load current or input voltage. Since the linear voltage reference is lower than the switching voltage reference, $V^l_{ref}<V^s_{ref}$, the switching regulator also stays on when the linear regulator is on. Thus, while linear regulator 300 responds quickly to a step load to prevent $V_{out}$ from dropping more than about 3% below $V_{norm}$, switching regulator 200 remains on to help to return $V_{out}$ to $V_{norm}$ again, some time after the beginning of the fluctuation.

Figure 2:
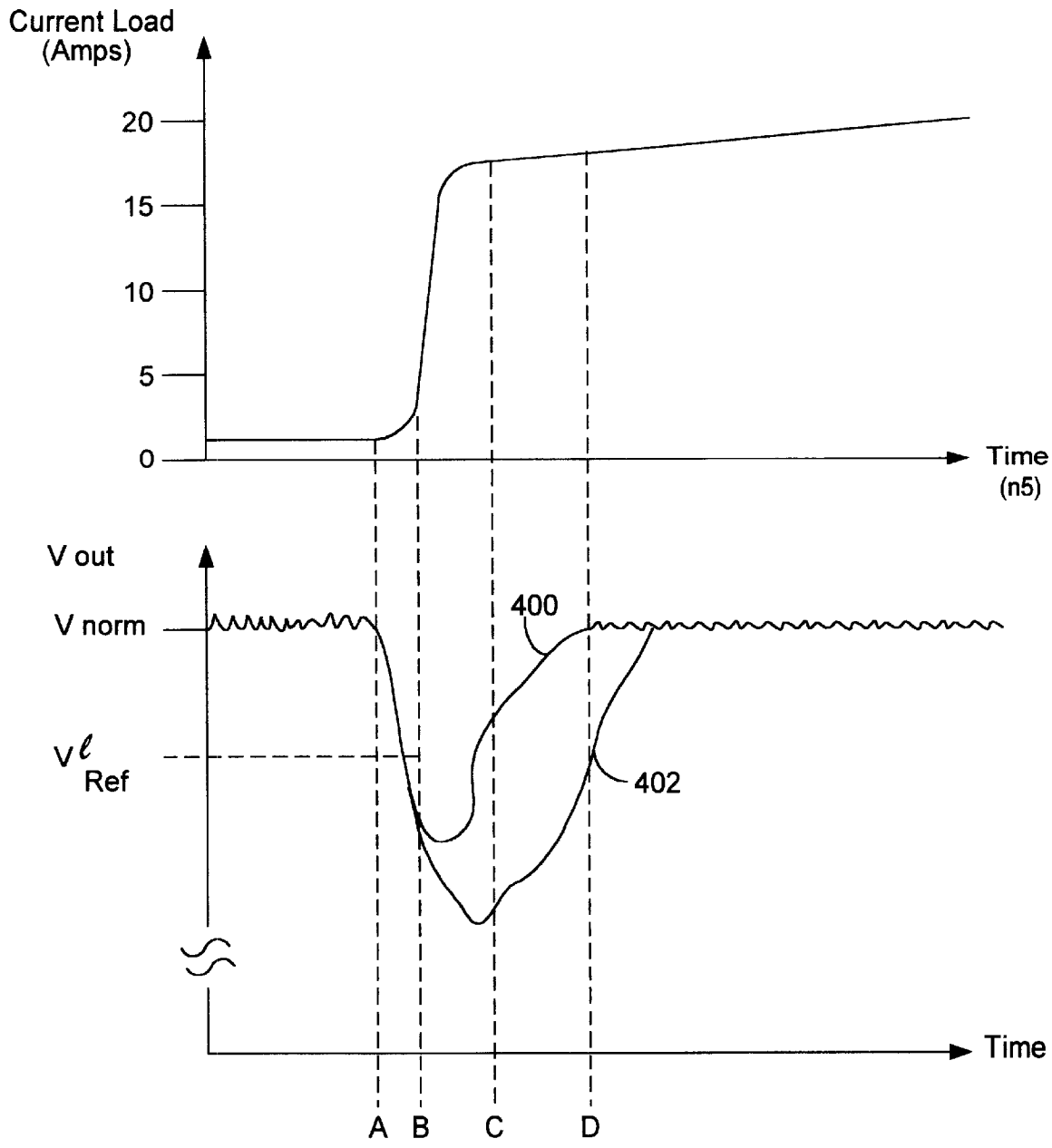
FIG. 2 is a graph of the output voltage of the booster voltage regulator before, during and after a large current step load.

Referring to FIG. 2, the temporal response of booster voltage regulator 100 to a step load is demonstrated by the simultaneous graphs of current load and $V_{out}$ as functions of time. Before time A, when the current load is relatively constant and stable, the voltage is held approximately equal to $V_{norm}$ by switching regulator 200. A step load in the current drawn from booster voltage regulator 100 begins at time A and causes $V_{out}$ to drop below $V_{norm}$. Between time A and time B, switching regulator 200 is turned on in response to the step load, but the voltage nevertheless falls from $V_{norm}$ to $V^l_{ref}$. At time B, $V_{out}$ has declined to $V^l_{ref}$, at which point linear regulator 300 turns on and slows the rate of decrease in $V_{out}$. Between time B and time C, both switching regulator 200 and linear regulator 300 are on because $V_{out}$ is lower than both $V^s_{ref}$ and $V^l_{ref}$. Path 400 shows the recovery of the output voltage due to the operation of both switching regulator 200 and linear regulator 300. Path 402 shows the recovery of the output voltage for a switching regulator alone, that is, the recovery of the output voltage to a step load if linear regulator 300 was not present. At time C, in recovery path 400, output voltage $V_{out}$ has recovered to $V^l_{out}$ and linear regulator 300 turns off. Between time C and time D switching regulator 200 continues to operate while output voltage $V_{out}$ rises approximately to $V_{norm}$. After time D, when $V_{out}$ has recovered to approximately $V^s_{ref}$ in path 400, switching regulator 200 resumes "switching" operation in response to small current load and input voltage fluctuations and maintains $V_{out}\approx V_{norm}$.

Although the linear voltage reference $V^l_{ref}$ is chosen such that it is approximately 1.5% less than switching voltage reference, $V^l_{ref}0.985V^s_{ref}$, $V^l_{ref}$ may be chosen to be any value less than $V^s_{ref}$. If $0.985V^s_{ref}<V^l_{ref}<V^s_{ref}$, then $V_{out}$ will be maintained closer to $V_{norm}$ during abrupt fluctuations, but linear voltage regulator 300 will turn on more often and will dissipate more power. If $V^l_{ref}<0.985V^s_{ref}$, then $V_{out}$ will fall farther below $V_{norm}$ during large current step loads, but linear voltage regulator 300 will not turn on as frequently and, therefore, less power will be dissipated.

An alternate implementation may use voltage dividers or multipliers so that some fraction or multiple of $V_{out}$ is compared with voltage references $V^s_{ref}$ and $V^l_{ref}$. Then, if $\alpha V_{out}<V^s_{ref}$ where $\alpha$ is a constant that may be chosen greater than, less than, or equal to 1, comparator 210 may send feedback to the switching regulator 200 through input 206 so that switching regulator 200 is turned on to drive $V_{out}$ higher. Similarly, if $\beta V_{out}<V^l_{ref}$, where $\beta$ is a constant that may be greater than, less than, or equal to 1, then comparator 310 may send feedback to the linear regulator 300 through input 306 so that linear regulator 300 is turned on to drive $V_{out}$ higher. When voltage dividers and multipliers are used, the constants $\alpha$ and $\beta$ are chosen such that a feedback signal is provided to input 206 to turn on switching regulator 200 when $V_{out}$ falls below $V_{norm}$ and a feedback signal is provided to input 306 to turn on linear regulator 300 when $V_{out}$ falls below approximately $0.985V_{norm}$.

Booster voltage regulator 100 may be used in computer bus termination applications (GTL and BTL) to provide a fast response to rapid load changes. Booster voltage regulator 100 may be configured to provide a 1.5 volt output, stable to within about 3% during a step load of 0 to 17A, and to within 1% within 30 microseconds after the beginning of the step load.

The present invention has been described in terms of specific embodiments, which are illustrative of the invention and not to be construed as limiting. Other embodiments are within the scope of the following claims.

What is claimed is:

1. A voltage regulator having a regulator output at a predetermined output voltage level comprising:

a switching regulator having a first regulated output providing a first output voltage level, where the first output voltage level is approximately equal to the predetermined output voltage level, the first regulated output being coupled to the regulator output;

a linear regulator having a second regulated output providing a second output voltage level where the second output voltage level is less than the first output voltage level, the second regulated output being coupled to the first regulated output such that the voltage at the regulator output is maintained at approximately the predetermined output voltage level by operation of the switching regulator until the regulator output falls below the second output voltage level at which time the regulator output is maintained at approximately the predetermined output voltage level by operation of the linear regulator, wherein the second output voltage level is approximately 1.5% less than the first output voltage level.

2. The voltage regulator of claim 1 wherein when the regulator output falls below the second output voltage level, the regulator output is maintained at approximately the predetermined output voltage level by operation of the linear regulator and the switching regulator.

3. The voltage regulator of claim 1 wherein the normal output voltage of the voltage regulator is approximately 1.5 V.

4. A method for maintaining an output voltage at a predetermined output voltage level comprising:

providing a switching regulator having a first regulated output maintained at a first output voltage level that is approximately equal to the predetermined output voltage level;

providing a linear regulator having a second regulated output maintained at a second output voltage level where the second output voltage level is approximately 1.5% less than the first output voltage level;

coupling the second regulated output to the first regulated output such that the output voltage is maintained at approximately the predetermined output voltage level by operation of the switching regulator until the output voltage falls below the second output voltage level at which time the output voltage is maintained at approximately the predetermined output voltage level by operation of the linear regulator.

5. The method of claim 4 wherein when the output voltage falls below the second output voltage level, maintaining the regulator output at approximately the predetermined output voltage level by operation of the linear regulator and the switching regulator until the output voltage exceeds the second output voltage level.

6. A voltage regulator for use in a computer bus termination application, comprising:

a switching regulator, implemented in a single integrated circuit, for generating an output voltage in accordance with a predetermined voltage level; and a linear regulator, implemented in a single integrated circuit, for boosting the output voltage generated by the switching regulator when the output voltage of the switching regulator source falls below a predetermined ratio of the predetermined voltage level, wherein the switching regulator is driven by a first external voltage source and the linear regulator is driven by a second external voltage source different from the first external voltage source, wherein the first external voltage source outputs a higher voltage than the second external voltage source, and wherein the predetermined ratio is at least approximately 0.95 and the predetermined voltage level is approximately 1.5 volts.

7. A voltage regulator, comprising:

a switching regulator for generating an output voltage in accordance with a predetermined voltage level;

a linear regulator for boosting the output voltage generated by the switching regulator when the output voltage of the switching regulator source falls below a predetermined ratio of the predetermined voltage level, wherein the switching regulator is driven by a first external voltage source and the linear regulator is driven by a second external voltage source different from the first external voltage source.

8. The voltage regulator of claim 7, wherein the first external voltage source outputs a higher voltage than the second external voltage source.

9. A voltage regulator, comprising:

a switching regulator for generating an output voltage in accordance with a predetermined voltage level;

a linear regulator for boosting the output voltage generated by the switching regulator when the output voltage of the switching regulator source falls below a predetermined ratio of the predetermined voltage level, wherein the predetermined ratio is at least approximately 0.95.

10. The voltage regulator of claim 9, wherein the predetermined voltage level is approximately 1.5 volts.

11. A voltage regulator, comprising:

a switching regulator for generating an output voltage in accordance with a predetermined voltage level;

a linear regulator for boosting the output voltage generated by the switching regulator when the output voltage of the switching regulator source falls below a predetermined ratio of the predetermined voltage level, wherein the linear regulator is implemented in a single integrated circuit.

12. The voltage regulator of claim 11, wherein the switching regulator is implemented in a single integrated circuit.

13. The voltage regulator of claim 11, wherein the linear regulator has a fast response time.

14. A voltage regulator, comprising:

a switching regulator for generating an output voltage in accordance with a predetermined voltage level;

a linear regulator for boosting the output voltage generated by the switching regulator when the output voltage of the switching regulator source falls below a predetermined ratio of the predetermined voltage level, wherein the voltage regulator is adapted for use in a computer bus termination application.

15. The voltage regulator of claim 14, wherein the predetermined voltage level is approximately 1.5 volts or less.

16. A voltage regulator, comprising:

means for generating an output voltage in accordance with a predetermined voltage level; and means for boosting the output voltage when the output voltage falls below a predetermined ratio of the predetermined voltage level, wherein the means for generating and the means for boosting are driven by separate voltage sources.

17. A method of regulating voltage for use in a computer bus termination application, comprising the steps of:

generating an output voltage in accordance with a predetermined voltage level;

boosting the output voltage when the output voltage falls below a predetermined ratio of the predetermined voltage level, wherein the predetermined ratio is at least 0.90.

18. The method of claim 17, wherein the predetermined ratio is approximately 0.985 and the predetermined voltage level is approximately 1.5 volts.

19. The method of claim 17, wherein the generating step comprises the substep of generating an output voltage based on a first external voltage source, and wherein the boosting step comprises the substep of boosting the output voltage based on a second external voltage source different from the first external voltage source.

20. A voltage regulator, comprising:

a switching regulator for generating an output voltage in accordance with a predetermined voltage level;

a linear regulator for boosting the output voltage generated by the switching regulator when the output voltage of the switching regulator source falls below a predetermined ratio of the predetermined voltage level;

a divider for dividing the output voltage;

a first reference source providing a first reference voltage level signal; and means for varying the output voltage in accordance with the difference between the divided output voltage and the first reference voltage level signal.

21. The voltage regulator of claim 20 further comprising a second divider for dividing the output voltage and producing a second divided output voltage;

a second reference source providing a second reference voltage level signal; and means for varying the output voltage in accordance with the difference between the second divided output voltage and the second reference voltage level signal.

22. A voltage regulator, comprising:

a switching regulator for generating an output voltage in accordance with a predetermined voltage level;

a linear regulator for boosting the output voltage generated by the switching regulator when the output voltage of the switching regulator source falls below a predetermined ratio of the predetermined voltage level;

a multiplier for multiplying the output voltage;

a first reference source providing a first reference voltage level signal; and means for varying the output voltage in accordance with the difference between the multiplied output voltage and the first reference voltage level signal.

23. The voltage regulator of claim 22 further comprising a second multiplier for multiplying the output voltage and producing a second multiplied output voltage;

a second reference source providing a second reference voltage level signal; and means for varying the output voltage in accordance with the difference between the second multiplied output voltage and the second reference voltage level signal.

* * * * *